United States Patent [19]

Hansen et al.

[11] Patent Number: 4,770,767

[45] Date of Patent: Sep. 13, 1988

[54] METHOD FOR THE FROTH FLOTATION OF COAL

[75] Inventors: Robert D. Hansen; Richard R. Klimpel, both of Midland, Mich.

[73] Assignee: The Dow Chemical Company, Midland, Mich.

[21] Appl. No.: 46,351

[22] Filed: May 6, 1987

[51] Int. Cl.[4] ..... B03D 1/02

[52] U.S. Cl. ..... 209/166; 252/61

[58] Field of Search ..... 209/166, 167; 252/61; 44/1 SR

[56] References Cited

U.S. PATENT DOCUMENTS

| | | | |
|---|---|---|---|
| 2,561,251 | 7/1951 | Aardt et al. | 209/166 |
| 2,687,214 | 8/1954 | Powell et al. | 209/166 |
| 3,865,718 | 2/1975 | Tveter | 209/166 |
| 4,272,364 | 6/1981 | Dixon et al. | 209/166 |
| 4,377,473 | 3/1983 | Laros et al. | 209/166 |
| 4,394,257 | 7/1983 | Wang et al. | 209/166 |
| 4,504,385 | 3/1985 | Keys | 209/166 |
| 4,526,680 | 7/1985 | Owen | 209/166 |
| 4,532,031 | 7/1985 | Wang et al. | 209/166 |
| 4,582,596 | 4/1986 | Hansen et al. | 209/166 |
| 4,589,980 | 5/1986 | Keys | 209/166 |

FOREIGN PATENT DOCUMENTS

| | | | |
|---|---|---|---|
| 1201223 | 2/1986 | Canada . | |
| 2234045 | 1/1973 | Fed. Rep. of Germany . | |
| 2156243 | 10/1985 | United Kingdom . | |
| 512794 | 5/1976 | U.S.S.R. . | |
| 735301 | 5/1980 | U.S.S.R. . | |
| 810285 | 3/1981 | U.S.S.R. . | |
| 810288 | 3/1981 | U.S.S.R. . | |
| 882626 | 11/1981 | U.S.S.R. . | |
| 891158 | 12/1981 | U.S.S.R. . | |
| 914089 | 3/1982 | U.S.S.R. . | |
| 937024 | 6/1982 | U.S.S.R. . | |
| 1045938 | 10/1983 | U.S.S.R. . | |
| 1071320 | 2/1984 | U.S.S.R. . | |
| 1077641 | 3/1984 | U.S.S.R. . | |
| 1077643 | 3/1984 | U.S.S.R. . | |
| 1079300 | 3/1984 | U.S.S.R. . | |
| 1082489 | 3/1984 | U.S.S.R. . | |
| 1082490 | 3/1984 | U.S.S.R. . | |
| 1087179 | 4/1984 | U.S.S.R. . | |
| 1068435 | 7/1984 | U.S.S.R. . | |
| 330688 | 3/1985 | U.S.S.R. . | |
| 1238801 | 6/1986 | U.S.S.R. | 209/166 |

OTHER PUBLICATIONS

Research Disclosure No. 173,014 (Derwent 70048A/39).

*Primary Examiner*—Kenneth M. Schor
*Assistant Examiner*—Thomas M. Lithgow

[57] ABSTRACT

The froth flotation of coal is conducted in the presence of a conditioner of an oxygen containing compound of the formula:

$$R_1\text{—O—}R_2)_n \qquad \text{(I)}$$

wherein $R_1$ and each $R_2$ are independently saturated hydrocarbyls and n is from 1 to about 3.

14 Claims, No Drawings

METHOD FOR THE FROTH FLOTATION OF COAL

BACKGROUND OF THE INVENTION

This invention relates to a method for the froth flotation of coal and, more particularly to the use of an ether as a conditioner for coal.

Combustible carbonaceous solid material ("coal") is inherently found in deposits containing non-combustible mineral matter. Although large fragments of the non-combustible materials can be removed by screening or conventional gravity concentration techniques such as centrifugation, froth flotation is more commonly employed to remove finer non-combustible materials from coal.

In the flotation process, it is desirable to recover as much coal as possible while effecting the recovery in a selective manner, i.e., minimizing the amounts of undesirable material or ash in the froth. Various flotation agents are used in the frothing process to maximize selective recovery of coal. For example, the froth flotation process is often conducted in the presence of a frother and collector, commonly an oil-type collector such as kerosene, to enhance the flotation process. A conventional frother used widely in commercial operations is methyl isobutyl carbinol. Many other alcohols are also disclosed as being useful as frothers in a coal flotation process (See, specifically, U.S. Pat. Nos. 4,272,364; 4,377,473; 4,504,385; and 4,582,596).

U.S. Pat. No. 4,394,257 suggests using a compound of the formula RW—$(CXY)_n$—Z wherein R is a 1-12C aliphatic radical, a phenyl or an alkylaryl, W is oxygen, sulfur, imino or alkyl substituted imino, n is 1-4, X and Y are hydrogen or a 1-8C saturated aliphatic radical and Z is —CN, —CO—$NH_2$, —C—OR″ or —O—R″ wherein R′ and R″ are 1-8C aliphatic radicals as a frother to improve selective recovery of mineral values and to reduce promoter consumption requirements. This frother is not believed to be widely used in commercial applications.

Many coals, particularly coals in which the surface has been at least partially oxidized such as sub-bituminous, are difficult to float. This results in an undesirable loss of significant amounts of combustible material in the tail from the flotation.

Increases in the amounts of this so-called "hard-to-float" coal recovered in the froth can be improved by increasing the concentration of the oil-type collector employed in the flotation process. Unfortunately, acceptable recovery can often be effected using such high amounts of the oil-type collector that significant amounts of the non-combustible matter are floated with the coal. Sun suggests in *Trans. AIME,* 199:396-401 (1954), that fatty amines can be utilized as co-collectors in the flotation of oxidized coals to effect enhanced recovery. However, even these amine collectors float substantial amounts of ash along with the coal and effect only partial recovery of combustible material.

A variety of other materials have been suggested for use to beneficiate coal in a froth flotation process. Such materials include the condensation product of a fatty acid or fatty acid ester with the reaction product of a polyalkylenepolyamine and an alkylene oxide (U.S. Pat. No. 4,305,815); the condensation product of an alkanolamine and a fatty acid or fatty acid ester (U.S. Pat. No. 4,474,619) and the reaction product of the condensation product of diethanolamine and a $C_{10-24}$ fatty acid with a $C_{1-4}$ monocarboxylic acid (U.S. Pat. No. 4,330,339). These materials can be effectively employed in the flotation of coal and are capable of the selective recovery of coal over ash at excellent rates of recovery. However, the fatty acid component of the conditioner is subject to variation in cost. In addition, further improvements in the selectivity of the froth flotation process or in the rate of coal recovery are always desirable.

Cyclohexanol propargyl ether has been suggested by Soviet Patent No. 1,077,641 as being another example of a material which is useful as a collector and/or foaming agent in coal flotation. However, this material is relatively expensive.

SUMMARY OF THE INVENTION

The present invention is a method for recovering coal using froth flotation. Specifically, the froth flotation method of the present invention comprises the step of floating coal in a frothing aqueous medium containing an effective amount of an oxygen containing compound of the formula:

$$R_1\text{-}(O\text{—}R_2)_n \qquad (I)$$

wherein $R_1$ and each $R_2$ are independently saturated hydrocarbyls and n is from 1 to about 3.

The method of the present invention can be effectively employed to recover coal. It is particularly useful in the recovery of the so-called "hard-to-float" coals. A relatively high selectivity of coal over ash and other non-combustible materials at excellent rates of recovery can often be obtained.

DETAILED DESCRIPTION OF THE INVENTION

In the present invention, the conditioner of formula (I) is advantageously a compound having a total of seven or more, more advantageously eight or more, most advantageously ten or more, carbon atoms. In general, the maximum number of carbon atoms in compound (I) will not exceed 36 and will advantageously be 30 or less, more advantageously 24 or less.

$R_1$ and each $R_2$ are advantageously independently an alkyl, cycloalkyl group or a combination of an alkyl and cycloalkyl , preferably an alkyl or cycloalkyl group. More preferably, $R_1$ is a $C_{1-20}$ alkyl or cycloalkyl, more preferably a $C_{1-16}$ alkyl, most preferably a $C_{2-12}$ alkyl and $R_2$ is a $C_{1-12}$ alkyl or cycloalkyl, more preferably a $C_{1-8}$ alkyl, most preferably a $C_{1-6}$ alkyl group. Preferably, n is from 1 or 2 and, more preferably, n is 1.

Representative examples of compounds which are within the foregoing definition are dihexyl ether, dibutyl ether, methyl hexyl ether, methyl octyl ether, methyl nonyl ether, methyl decyl ether, methyl dodecyl ether, ethyl hexyl ether, ethyl octyl ether, ethyl nonyl ether, ethyl decyl ether, ethyl dodecyl ether, ethyl octadecyl ether, n- or isopropyl hexyl ether, n- or isopropyl octyl ether, and the like. The most preferred ethers for use as conditioners in the practice of the present invention is dihexyl ether, ethyl octadecyl ether, methyl hexyl ether, and methyl octyl ether.

The conditioner is employed in an effective amount. By the term "effective amount", it is meant that the ether conditioner is employed in an amount sufficient to improve the froth flotation process as compared to an identical froth flotation process except using no conditioner. The ether conditioner is most advantageously employed in an amount which gives the greatest recovery of combustible carbonaceous matter with a tolerable amount of ash and other non-combustible or inert matter. This concentration will vary depending on a variety of factors including the size, rank, degree of oxidation and the content of inert matter in the coal feed; the specific frother, if any, employed and the concentration of the frother as well as the type and concentration of any other materials employed in the froth flotation process and their concentration; and the specific ether conditioner employed. In general, the ether conditioner is advantageously employed in an amount of from about 0.001 to about 1.0, preferably from about 0.002 to about 0.2 kilograms of conditioner per metric ton of coal (dry weight basis) being treated.

The ether conditioners can be utilized in conjunction with other conditioners or collectors and other adjuvants such as activators, dispersing reagents, frothers, depressing agents and the like.

Of these materials, a frother is commonly employed in the froth flotation process to promote formation of a froth. Any material capable of promoting the formation of the froth can be employed as a frother herein. Conventionally, frothers are materials containing one or more hydroxyl groups although other materials which are capable of promoting the formation of a froth can also be employed. Representative frothers include monohydroxylated compounds such as pine oil, cresol, $C_4$ to $C_8$ containing one or two tertiary or one quaternary carbon atom, the reaction product of a $C_{1-6}$ monohydroxy alcohol and propylene oxide or a mixture of propylene oxide and butylene oxide, $C_{1-4}$ alkyl ethers of polypropylene glycols reacted with propylene oxide, terpineol, methyl isobutyl carbinol; dihydroxylated compounds such as polypropylene glycol; and tri- or higher- hydroxylated compounds such as the reaction product of a $C_{1-20}$ alkane, sucrose, a monosaccharide, disaccharide or a $C_{3-20}$ cycloalkane having three or more hydroxy groups with propylene oxide or a mixture of propylene oxide and ethylene oxide such as described in U.S. patent application No. 646,339, filed Aug. 29, 1984.

Preferred frothers are methyl isobutyl carbinol, polypropylene methyl ethers having a weight average molecular weight between about 200 and about 600 and the reaction product of $C_{4-6}$ alcohols and propylene oxide. The reaction product of a $C_{4-6}$ monohydroxy alcohol and propylene oxide is most preferred.

The amount of frother most advantageously employed in the flotation medium is influenced by a number of factors, most important of which is the rank and degree of oxidation of the coal. Generally, the frother is preferably employed in an amount from about 0.05 to about 0.5 kilogram frother per ton of coal feed (dry weight basis).

A fuel oil collector is also commonly employed in the flotation medium and the froth flotation process of the present invention is preferably conducted using a fuel oil collector or conditioner in combination with the ether conditioner. Representative fuel oils include diesel oil, kerosene, Bunker C fuel oil, mixtures thereof and the like. The amount of fuel oil most advantageously employed in the froth flotation is influenced by numerous factors including the size, degree of oxidation and rank of the coal to be floated and the amount of the ether conditioner and frother,if any, employed, particularly the amounts of conditioner employed . The fuel oil is preferably employed in amounts which effect the greatest selectivity and recovery during flotation and such amounts are easily determined by persons skilled in the art. In general, the fuel oil can advantageously be employed in an amount from about 0.01 to about 5, preferably from about 0.02 to about 2.5, kilograms fuel oil per metric ton of coal flotation feed (dry weight basis). In one preferred embodiment, the ether conditioner is charged to the aqueous flotation medium dispersed in part or all of the fuel oil charge.

In addition, the ether conditioner can be employed in combination with other conditioners such as the condensation product of a fatty acid or fatty acid ester with an alkanolamine such as described in U.S. Pat. No. 4,474,619; the condensation product of a fatty acid or fatty acid ester with the reaction product of a polyalkylenepolyamine and an alkylene oxide such as described in U.S. Pat. No. 4,305,815; the reaction product of the condensation product of diethanolamine and a $C_{10-24}$ fatty acid with a $C_{1-4}$ monocarboxylic acid such as described in U.S. Pat. No. 4,330,339; and the reaction product of naphthenic acid and an alkanolamine such as described in Application Ser. No. 888,319, filed July 21, 1986, allowed Dec. 22, 1987 and aryl sulfonates such as described in U.S. Pat. No. 4,308,133. In general, when the ether conditioner is employed in combination with another conditioner, the conditioner combination is advantageously employed in an amount from about 0.0001 to about 0.7, preferably from about 0.0002 to about 0.15, kilograms of ether conditioner per metric ton of coal flotation feed and from about 0.0003 to about 0.9, preferably from about 0.0004 to about 0.16, kilograms of the other conditioner(s) per metric ton of coal flotation feed.

The process of the present invention can be employed to float anthracite, bituminous, sub-bituminous coal or the like. The process is preferably employed to float coal of intermediate or low rank where the surface of the coal is oxidized to an extent which significantly impedes the flotation of the coal using a conventional fuel oil collector.

Although coal as large as 10 mesh has been floated using froth flotation processes, in general, the size of the coal particles to be separated by flotation are generally less than about 28 mesh (U.S. Sieve Size). If a substantial fraction of the coal in the flotation feed comprises particles larger than 28 mesh, it is generally desirable that the feed be comminuted further prior to flotation. The weight average particle size of the coal to be floated is generally from about 177 (80 mesh) to about 125 micrometers (120 mesh).

The sized coal flotation feed optionally is first washed and then mixed with sufficient water to prepare an aqueous slurry having a solids concentrate which promotes rapid flotation. Generally, a solids concentration between about 2 to about 20 weight percent solids, more preferably from about 5 to about 12 weight percent, is employed. The aqueous coal slurry is advantageously conditioned with the ether conditioner, a fuel oil collector, and any other adjuvants using methods known to the art. Generally for difficult to float coal, prior to flotation, it is advantageous to contact the coal slurry with the conditioner and fuel oil at conditions which effect intimate contact of the conditioner and fuel oil with substantially all of the coal. In those instances where the aqueous coal slurry is prepared in a container distinct from the flotation cell and then is conveyed to the flotation through conduits, the desired intimate contact can conveniently be attained by introducing the conditioner and fuel oil to the slurry upstream from the flotation cell. Although the frother can be introduced to the slurry during conditioning, it is more preferable to add the frother to the slurry only shortly before flotation or during flotation.

The coal can be floated at the natural pH of the coal in the aqueous slurry, which will conventionally vary from about 3.0 to about 9.5. However, the pH of the aqueous coal slurry is advantageously maintained, prior to and during flotation, at a value from about 4 to about 9, preferably about 4 to about 8, which generally promotes the greatest coal recovery. If the coal is acidic in character, the pH can be adjusted using an alkaline material such as soda ash, lime, ammonia, potassium hydroxide or magnesium hydroxide, with sodium hydroxide being preferred. If the aqueous coal slurry is alkaline in character, a carboxylic acid, such as acetic acid or the like, or a mineral acid, such as sulfuric acid, hydrochloric acid and the like, can be employed to adjust the pH.

The conditioned and pH-adjusted aqueous coal slurry is aerated in a conventional flotation machine or bank of rougher cells to float the coal. Any suitable rougher flotation unit can be employed.

The practice of the process of the instant invention can be used alone to beneficiate coal. Alternatively, the process can be used in conjunction with secondary flotations following the instant process to effect even greater beneficiation of the coal.

The following examples are included to illustrate the invention only and should not be construed to limit its scope. Unless otherwise indicated, all parts and percentages are by weight.

EXAMPLE 1

A 195 gram (g) sample (dry weight) of Conesville coal is added to an Agitair® type froth flotation cell containing 2800 milliliters (ml) of deionized water to from a 6.5 percent solids slurry. The coal is lightly oxidized coal.

The coal slurry is agitated at 900 r.p.m. for six minutes to thoroughly wet the coal. At the end of this period, 0.1 g of a five weight percent solution of dihexyl ether, a conditioner useful in the practice of the present invention, in a purified kerosene sold as Soltrol® 100 (a hydrocarbon collector) is added to the slurry. This corresponds to using 0.5 kilogram of the conditioner/-collector mixture per metric ton of coal (kg/ton). The resulting mixture is conditioned by agitation for an additional minute. At the end of this time, 0.02 g of a polypropylene oxide methyl ether frother having a weight average molecular weight of 400 sold as Dowfroth® 1012 by The Dow Chemical Company is added to the coal slurry. After frother addition, the slurry is conditioned by agitation for an additional minute, after which aeration of the slurry is initiated and the paddles started. Samples of the frothy concentrate are collected at 0.5 minute and 4 minutes after beginning the froth paddles. The unfloated tailings are also collected.

The collected concentrates ("heads") are dewatered using a vacuum filter and then dried in a drying oven. The dried sample is then weighed. The ash content of each sample is determined using ASTM test method designated 3174-73 entitled "Standard Method of Test for Ash in the Analysis Sample of Coal and Coke". The fractional clean coal recovery (as determined as the weight of the dried sample less the measured amounts of ash) and the fractional ash recovery at 0.5 and 4 minutes is measured and reported in Table I.

EXAMPLE 2

Different samples of the same lightly oxidized Conesville coal are recovered using the same techniques as employed in Example 1 except the methyl hexyl ether is employed in place of dihexyl ether. The fractional clean coal recovery and fractional ash recovery of each sample at 0.5 and 4 minutes is also calculated using the described techniques and the results reported in Table I.

EXAMPLE 3

Different samples of the same lightly oxidized Conesville coal are recovered using the same techniques as employed in Example 1 except that octadecyl ethyl ether is employed in place of dihexyl ether. The fractional clean coal recovery and fractional ash recovery at 0.5 and 4 minutes is also calculated using the described techniques and the results reported in Table I.

COMPARATIVE EXAMPLE A

A flotation run is conducted in an identical manner to Example 1 except that no ether conditioner is employed in the flotation. The fractional clean coal recovery and fractional ash recovery at 0.5 and 4 minutes is also calculated using the described techniques and the results reported in Table I.

TABLE I

| | | Fractional Clean Coal Recovery, | | Fractional Ash Recovery, | | % Increase Clean Coal |
|---|---|---|---|---|---|---|
| Example No. | Conditioner | 0.5 min. | 4 min. | 0.5 min. | 4 min. | Recovery 4 min. |
| A | None | 0.464 | 0.510 | 0.235 | 0.269 | — |
| 1 | dihexyl ether | 0.541 | 0.603 | 0.270 | 0.318 | 18.2 |
| 2 | methyl hexyl ether | 0.591 | 0.638 | 0.318 | 0.358 | 25.1 |
| 3 | octadecyl ethyl ether | 0.556 | 0.615 | 0.322 | 0.371 | 20.6 |

As evidenced by the data set forth in Table I, the flotation method of the present invention which employs an ether as a conditioner provides enhanced recovery of coal relative to the same froth flotation method using no conditioner.

EXAMPLE 4

A different sample of the same lightly oxidized coal as employed in Examples 1–3 is recovered using the same techniques as employed in Example 2 except that n-docecane is employed as the hydrocarbon collector instead of Soltrol® 100. The fractional clean coal recovery and fractional ash recovery at 0.5 and 4 minutes are determined and are set forth in Table II.

COMPARATIVE EXAMPLE B

A different sample to the same lightly oxidized coal as employed in Comparative Example A is recovered using the same techniques as employed in Comparative Example A except that n-docecane is employed as the hydrocarbon collector instead of Soltrol® 100. The fractional clean coal recovery and fractional ash recovery at 0.5 and 4 minutes are determined and are set forth in Table II.

TABLE II

| Example No. | Conditioner | Fractional Clean Coal Recovery, 0.5 min. | Fractional Clean Coal Recovery, 4 min. | Fractional Ash Recovery, 0.5 min. | Fractional Ash Recovery, 4 min. |
|---|---|---|---|---|---|
| B | None | 0.634 | 0.691 | 0.356 | 0.397 |
| 4 | methyl hexyl ether | 0.678 | 0.744 | 0.401 | 0.458 |

As evidenced by the data set forth in foregoing Table II, the flotation method of the present invention improved the fractional clean coal recovery by 7.7 percent as compared to the comparative example.

EXAMPLE 5

A sample of a different lightly oxidized coal is recovered using the same techniques as employed in Example 1 except that diphenyl oxide is employed in place of the dihexyl ether. The fractional clean coal recovery and fractional ash recovery at 0.5 and 4 minutes are determined and are set forth in Table III.

COMPARATIVE EXAMPLE C

A different sample of the lightly oxidized coal as employed in Example 5 is recovered using the same techniques as employed in Example 5 except there is no ether conditioner employed. The fractional clean coal recovery and fractional ash recovery at 0.5 and 4 minutes are determined and are set forth in Table III.

TABLE III

| Example No. | Conditioner | Fractional Clean Coal Recovery, 0.5 min. | Fractional Clean Coal Recovery, 4 min. | Fractional Ash Recovery, 0.5 min. | Fractional Ash Recovery, 4 min. |
|---|---|---|---|---|---|
| C | None | 0.594 | 0.710 | 0.0989 | 0.148 |
| 5 | diphenyl oxide | 0.613 | 0.730 | 0.104 | 0.159 |

As evidenced by the data set forth in foregoing Table III, the flotation method of the present invention improved the fractional clean coal recovery as compared to the comparative example.

What is claimed is:

1. A method for recovering coal from a coal ore containing coal and non-combustible mineral matter which comprises the step of floating coal in a frothing aqueous medium containing an oxygen containing compound of the formula:

$$R_1—O—R_2 \quad (I)$$

wherein $R_1$ and $R_2$ are independently saturated hydrocarbyls, said oxygen containing compound being present in said medium in an amount effective to selectively concentrate said coal in the froth.

2. The method of claim 1 wherein the coal has an oxidized surface.

3. The method of claim 1 wherein $R_1$ and $R_2$ are advantageously independently an alkyl, cycloalkyl group or a combination of an alkyl and cycloalkyl.

4. The method of claim 3 wherein the total number of carbon atoms in compound (I) is at least seven.

5. The method of claim 1 wherein the total number of carbon atoms in compound (I) is at least ten.

6. The method of claim 4 wherein $R_1$ is a $C_{1-20}$ alkyl or cycloalkyl and $R_2$ is a $C_{1-12}$ alkyl or cycloalkyl group.

7. The method of claim 6 wherein $R_1$ is a $C_{2-12}$ alkyl and $R_2$ is a $C_{1-6}$ alkyl group.

8. The method of claim 1 wherein compound (I) is octadecyl ethyl ether, methyl hexyl ether, dihexyl ether, dibutyl ether, methyl octyl ether, methyl nonyl ether, methyl decyl ether, methyl dodecyl ether, ethyl hexyl ether, ethyl octyl ether, ethyl nonyl ether, ethyl decyl ether, ethyl dodecyl ether, ethyl octadecyl ether, n- or isopropyl hexyl ether, or n- or isopropyl octyl ether.

9. The method of claim 8 wherein compound (I) is dihexyl ether, ethyl octadecyl ether, methyl hexyl ether or methyl octyl ether.

10. The method of claim 1 wherein compound (I) is employed in an amount from about 0.001 to about 1.0 kilograms per metric ton of coal ore.

11. The method of claim 10 wherein from about 0.02 to about 2.5 kilograms of the fuel oil are employed per metric ton of coal ore (as calculated on a dry weight basis).

12. The method of claim 10 wherein the aqueous frothing medium further comprises a frother.

13. The method of claim 12 wherein the frother is methyl isobutyl carbinol or a polypropylene methyl ether having a weight average molecular weight between about 200 and about 600.

14. The method of claim 13 wherein the frother is employed in an amount of from about 0.05 to about 0.5 kilogram frother per ton of coal ore (dry weight basis).

* * * * *